US010816193B2

(12) United States Patent
Chen

(10) Patent No.: US 10,816,193 B2
(45) Date of Patent: Oct. 27, 2020

(54) WIND RESISTANT OUTDOOR HEATER BURNER

(71) Applicant: Grand Hall Enterprise Co., Ltd., Taipei (TW)

(72) Inventor: Wei-Long Chen, Taichung (TW)

(73) Assignee: Grand Hall Enterprise Co., Ltd., Taipei (TW)

( * ) Notice: Subject to any disclaimer, the term of this patent is extended or adjusted under 35 U.S.C. 154(b) by 565 days.

(21) Appl. No.: 15/679,249

(22) Filed: Aug. 17, 2017

(65) Prior Publication Data

US 2019/0056102 A1 Feb. 21, 2019

(51) Int. Cl.

| | |
|---|---|
| ***F23D 14/14*** | (2006.01) |
| ***F24D 19/00*** | (2006.01) |
| ***F23D 14/70*** | (2006.01) |
| ***F24H 9/00*** | (2006.01) |
| ***F23D 14/04*** | (2006.01) |
| *F24D 15/02* | (2006.01) |

(52) U.S. Cl.

CPC ..... *F23D 14/14* (2013.01); *F23D 14/045* (2013.01); *F23D 14/70* (2013.01); *F24D 19/0024* (2013.01); *F24H 9/0063* (2013.01); *F23D 2203/102* (2013.01); *F23D 2212/10* (2013.01); *F24D 15/02* (2013.01)

(58) Field of Classification Search

CPC ..... F23D 14/14; F23D 14/70; F23D 2203/102
See application file for complete search history.

(56) References Cited

U.S. PATENT DOCUMENTS 3,084,736 A * 4/1963 Mentel ..... F23D 14/145 431/329
3,167,110 A * 1/1965 Charles ..... F23D 14/14 431/328
3,270,967 A * 9/1966 Westerman ..... F23D 14/10 239/560
3,353,583 A * 11/1967 Silhavy ..... F23D 14/145 431/329
3,437,415 A * 4/1969 Flockhart ..... F23D 14/14 431/328
3,805,763 A * 4/1974 Cowan ..... F24H 3/0411 126/92 R (Continued)

FOREIGN PATENT DOCUMENTS

CN 104048351 B 9/2016

*Primary Examiner* — Avinash A Savani
*Assistant Examiner* — Deepak A Deean
(74) *Attorney, Agent, or Firm* — Adam D. Kamrath; Karin L. Williams; Mayer & Williams PC

(57) ABSTRACT

A windproof outdoor heater burner includes a casing and a flow-guiding device. The casing includes an inlet and an outlet. The flow-guiding device includes an inlet pipe connected to the inlet, a flow-guiding member, and a diffuser plate connected to the outlet. The flow-guiding member is connected to the inlet pipe. The flow-guiding member includes a flow-guiding channel therein and a plurality of first through-holes. Each first through-hole includes a first end intercommunicated with the flow-guiding channel and a second end intercommunicated with a chamber of the casing. The diffuser plate includes a plurality of first exhaust holes located between two sides thereof and intercommunicated with the chamber of the casing. The first exhaust holes are not aligned with the flow-guiding member.

20 Claims, 12 Drawing Sheets

(56) References Cited

U.S. PATENT DOCUMENTS

| | | | | | |
|---|---|---|---|---|---|
| 4,248,586 | A * | 2/1981 | Cooper | F23D 14/12 | 431/328 |
| 4,976,609 | A * | 12/1990 | Grob | F23D 14/14 | 126/343.5 R |
| 5,101,558 | A * | 4/1992 | Grob | F23D 14/14 | 29/527.2 |
| 6,659,765 | B1 * | 12/2003 | Sen-Yu | F23D 14/145 | 126/92 AC |
| 2009/0053664 | A1 * | 2/2009 | Staller | F23C 13/08 | 431/328 |
| 2017/0122555 | A1 * | 5/2017 | Owens | F23D 14/145 | |

* cited by examiner

WIND RESISTANT OUTDOOR HEATER BURNER

BACKGROUND OF THE INVENTION

The present invention relates to a heater burner and, more particularly, to a wind resistant outdoor heater burner.

China Patent Application No. 201410258948.7 discloses a high power infrared horizontal heat radiation outdoor fuel gas heater (hereinafter referred to as "the heater") including a box body for containing a fuel gas bottle. An ignition control device is arranged on the box body. Universal wheels are arranged at the bottom of the box body. An opening is formed in a front panel of the box body. At least two mutually independent infrared fuel gas burners (herein after referred to as "the burners") are arranged at the opening. The burners are arranged in the horizontally outward radiation direction. A metal mesh enclosure is arranged on the opening.

The heater is generally used outdoors. In use, gas is mixed with air in a gas mixing chamber of the burners. Then, the pressure in the gas mixing chamber blows the mixture outward via pores of porous ceramic plates for subsequent combustion of the mixture. Since the burners with the ceramic plates provide directional heating and have a large combustion area, the high heat of combustion generates a large proportion of infrared heat radiation on the surfaces of the burners and, thus, can provide a highly efficient radiation heat source. This is critical to use in the outdoor environment, because the user can immediately feel comfortable and warm when irradiated with heat similar to the sunlight. However, the burners are liable to extinguish, because the outlets of the ceramic plates are directly subject to wind and have a large windward area. In a case of a strong wind or a gust, backpressure or turbulence is apt to be generated on the surfaces of the burners, failing to maintain the conditions for combustion. Combustion of the burners requires a uniform supply of air and a stable mixture concentration as well as a stable pressure in the gas mixing chamber, such that the mixture flows out of the surfaces of the ceramic plates at a constant low speed for the purpose of maintaining normal and stable combustion.

The heater is for generating thermal radiation for outdoor use. In a real application, gas is mixed with air in a gas mixing chamber of the burners. Then, the pressure in the gas mixing chamber enforces the gas mixture flowing outward of the burner via the pores of the porous ceramic tiles for subsequent combustion. Since the burners with the ceramic tiles provide directional heating and have a large combustion area, the high heat of combustion generates a large proportion of infrared heat radiation on the surfaces of the burners and, thus, can provide an effective radiation heat source. Using radiation heating is critical for the outdoor environment since the user can immediately feel comfortable and warm from the infrared irradiated with heat similar to the sunlight.

However, typical ceramic tile radiant burners are liable to fail under an outdoor environment since the ceramic tiles with a large surface area are exposed directly to the outdoor environment. To maintaining normal and stable combustion requires both consistent supplies of low-speed air flow and a correct mixture of gas fuel. Under the strong or gusty wind environment, high back pressure or turbulence directly applying on the tile surfaces cause the burners to fail to maintain the proper conditions for combustion, induce burner extinction, and even cause risks.

It is inevitable to expose environmental winds to the outdoor radiant heaters. When the wind is too strong, the back pressure and turbulence generated on the ceramic tile surface on the burners by a strong wind or gust often extinguish or even cause dangers, with dangers including, but not limited to, two major risks.

Two types of risks for typical radiant burners are flashback and flashover. Flashback is a condition where the flame is burning inside the mixing chamber of the burner. The strong wind directly blows into the gas mixing chamber and pushes the flame into the gas mixing chamber, leading to a backfire that causes combustion inside the gas mixing chamber rather than outside of the gas mixing chamber. Thus, a large amount of heat is accumulated instantaneously in the gas mixing chamber, which is very dangerous. Operating at this condition can ruin the burner or the whole device.

Flashover occurs when the flame ignites an accumulated gas mixture around the burner. This causes a "huffing" noise and can lead to flashover occurring outside the burner. Periodic gusts can cause instability and extinction. Sometimes, the wind extinguishes the flame, but the gas control system cannot detect extinction of the flames immediately and still keeps supplying gas. Thus, the gas will accumulate in or around the heater. When the heater resumes ignition after the wind becomes smaller or stops, the high-concentration gas mixture around the heater will be ignited at the same time, resulting in a large-scale burning or even a flashover.

Thus, a need exists for a novel windproof outdoor heater burner to overcome the above disadvantages.

BRIEF SUMMARY OF THE INVENTION

A windproof outdoor heater burner according to the present invention includes a casing and a flow-guiding device. The casing defines a chamber and includes an inlet and an outlet spaced from the inlet in a longitudinal direction. The inlet and the outlet intercommunicate with the chamber. The flow-guiding device includes an inlet pipe, a flow-guiding member, and a diffuser plate. The inlet pipe is connected to the inlet. The inlet pipe includes a first end and a second end opposite to the first end. The first end of the inlet pipe is located outside of the casing. The second end of the inlet pipe is located in the chamber of the casing.

The flow-guiding member is connected to the second end of the inlet pipe. The flow-guiding member includes a flow-guiding channel therein and a plurality of first through-holes. Each of the plurality of the first through-holes includes a first end intercommunicated with the flow-guiding channel and a second end intercommunicated with the chamber of the casing. The flow-guiding channel includes a first area extending non-rectilinearly from the second end of the inlet pipe to the plurality of first through-holes.

The diffuser plate is connected to the outlet and includes a first side and a second side opposite to the first side. The diffuser plate further includes a plurality of first exhaust holes located between the first side and the second side and intercommunicated with the chamber of the casing. The plurality of first exhaust holes is not aligned with the flow-guiding member.

In an example, the flow-guiding channel includes a first section and a second section at a non-parallel angle to the first section to form a turn therebetween. The first section intercommunicates with the inlet pipe. The first section and the second section are connected and intercommunicate with each other. The flow-guiding member further includes a first baffle adjacent to an inner periphery of the first section. The first baffle is on a side of the first section opposite to the inlet pipe and faces the second end of the inlet pipe. The flow-guiding member further includes a second baffle adjacent to an inner periphery of the second section. The second baffle is on a side of the second section opposite to the first section and faces an end of the first section opposite to the inlet pipe and adjacent to the second section. The plurality of first through-holes is located on a side of the flow-guiding member adjacent to the second section but opposite to the second baffle.

In an example, the flow-guiding channel further includes a third section. The third section is connected and intercommunicates with an end of the first section opposite to the second section. The first section is at a non-parallel angle to the third section to form a turn therebetween. The flow-guiding member further includes a third baffle adjacent to an inner periphery of the third section. The third baffle is on a side of the third section opposite to first section and faces an end of the first section opposite to the second section. A side of the flow-guiding member adjacent to the third section but opposite to the third baffle includes a plurality of second through-holes. Each of the plurality of second through-holes has a first end intercommunicated with the flow-guiding channel and a second end intercommunicated with the chamber of the casing. The flow-guiding channel includes a second area extending non-rectilinearly from the second end of the inlet pipe to the plurality of second through-holes.

In an example, the flow-guiding channel further includes a fourth section and a fifth section. The fourth section is connected with the first section and the second section and extends in a direction away from the second section. The second section and the fourth section extend along the same axis parallel to a longitudinal axis. The second baffle is located adjacent to the inner periphery of the second section and an inner periphery of the fourth section. A turn is formed between the first section and the fourth section.

A side of the flow-guiding member adjacent to the fourth section but opposite to the second baffle includes a plurality of third through-holes. Each of the plurality of the third through-holes has a first end intercommunicated with the flow-guiding channel and a second end intercommunicated with the chamber of the casing. The flow-guiding channel further includes a third area extending non-rectilinearly from the second end of the inlet pipe to the plurality of third through-holes.

The fifth section is connected to the first section and the third section and extends in a direction away from the third section. The third section and the fifth section extend along the same axis parallel to the longitudinal axis. The third baffle is adjacent to the inner periphery of the third section and an inner periphery of the fifth section. A turn is formed between the first section and the fifth section.

A side of the flow-guiding member adjacent to the fifth section but opposite to the third baffle includes a plurality of fourth through-holes. Each of the plurality of fourth through-holes has a first end intercommunicated with the flow-guiding channel and a second end intercommunicated with the chamber of the casing. The flow-guiding channel further includes a fourth area extending non-rectilinearly from the second end of the inlet pipe to the plurality of fourth through-holes.

In an example, the inlet and the outlet are respectively defined in two adjacent sides of the casing. The inlet pipe further includes a neck located between the first end and the second end of the inlet pipe and received in the inlet of the casing. An inner cross-sectional area of the neck perpendicular to the longitudinal axis is smaller than an inner cross-sectional area of the first end or the second end of the inlet pipe perpendicular to the longitudinal axis. The sum of areas of the plurality of first exhaust holes in the diffuser plate is larger than the inner cross-sectional area of the neck.

In an example, the plurality of first exhaust holes in the diffuser plate has gradually reducing areas from the first side to the second side along the longitudinal axis. The first side of the diffuser plate is adjacent to the inlet of the casing. The second side of the diffuser plate is adjacent to a side of the casing opposite to the inlet.

In an example, the flow-guiding device further includes a first partitioning member abutting a side of the diffuser plate opposite to the casing and extending away from the casing. The first partitioning member is aligned with an area of the diffuser plate having the plurality of first exhaust holes. The plurality of first exhaust holes is divided into two sections by the first partitioning member.

In an example, the flow-guiding device further includes a second partitioning member and a third partitioning member. The second partitioning member and the third partitioning member abut the side of the diffuser plate opposite to the casing and extend away from the casing. The second partitioning member is aligned with the area of the diffuser plate having the plurality of first exhaust holes. The plurality of exhaust holes is divided into two sections by the second partitioning member. An extending direction of the first partitioning member is parallel to an extending direction of the second partitioning member. An extending direction of the third partitioning member is perpendicular to the extending direction of the first partitioning member. The third partitioning member intersects with the first partitioning member and the second partitioning member.

In an example, the flow-guiding device further includes a ceramic plate disposed on the side of the diffuser plate opposite to the casing. The ceramic plate includes a plurality of through-holes extending from a side of the ceramic plate adjacent to the diffuser plate through another side of the ceramic plate opposite to the diffuser plate. The ceramic plate abuts a side of the first partitioning member, a side of the partitioning member, and a side of the partitioning member. The sides of the first, second, and third partitioning members are opposite to the diffuser plate.

In an example, the inlet and the outlet are respectively defined in two adjacent sides of the casing. The inlet pipe further includes a neck located between the first end and the second end of the inlet pipe and received in the inlet of the casing. An inner cross-sectional area of the neck perpendicular to the longitudinal axis is smaller than an inner cross-sectional area of the first end or the second end perpendicular to the longitudinal axis. The diffuser plate further includes a plurality of second exhaust holes located between the first side and the second side, intercommunicated with the chamber of the casing, and not aligned with the flow-guiding member. A sum of areas of the plurality of first exhaust holes and the plurality of second exhaust holes in the diffuser plate is larger than the inner cross-sectional area of the neck perpendicular to the longitudinal axis.

In an example, the plurality of first exhaust holes in the diffuser plate has gradually reducing areas from the first side to the second side along the longitudinal axis. The first side of the diffuser plate is adjacent to the inlet of the casing. The second side of the diffuser plate is adjacent to a side of the casing opposite to the inlet. The plurality of second exhaust holes in the diffuser plate has gradually reducing areas from the second side to the first side along the longitudinal axis.

In an example, the first section of the flow-guiding channel is aligned with an area of the diffuser plate having the plurality of first exhaust holes and the plurality of several second exhaust holes.

In an example, the flow-guiding device further includes a ceramic plate on a side of the diffuser plate opposite to the casing. The ceramic plate includes a plurality of through-holes extending from a side of the ceramic plate adjacent to the diffuser plate through another side of the ceramic plate opposite to the diffuser plate.

The present invention will become clearer in light of the following detailed description of illustrative embodiments of this invention described in connection with the drawings.

DETAILED DESCRIPTION OF THE INVENTION

Figure 1:
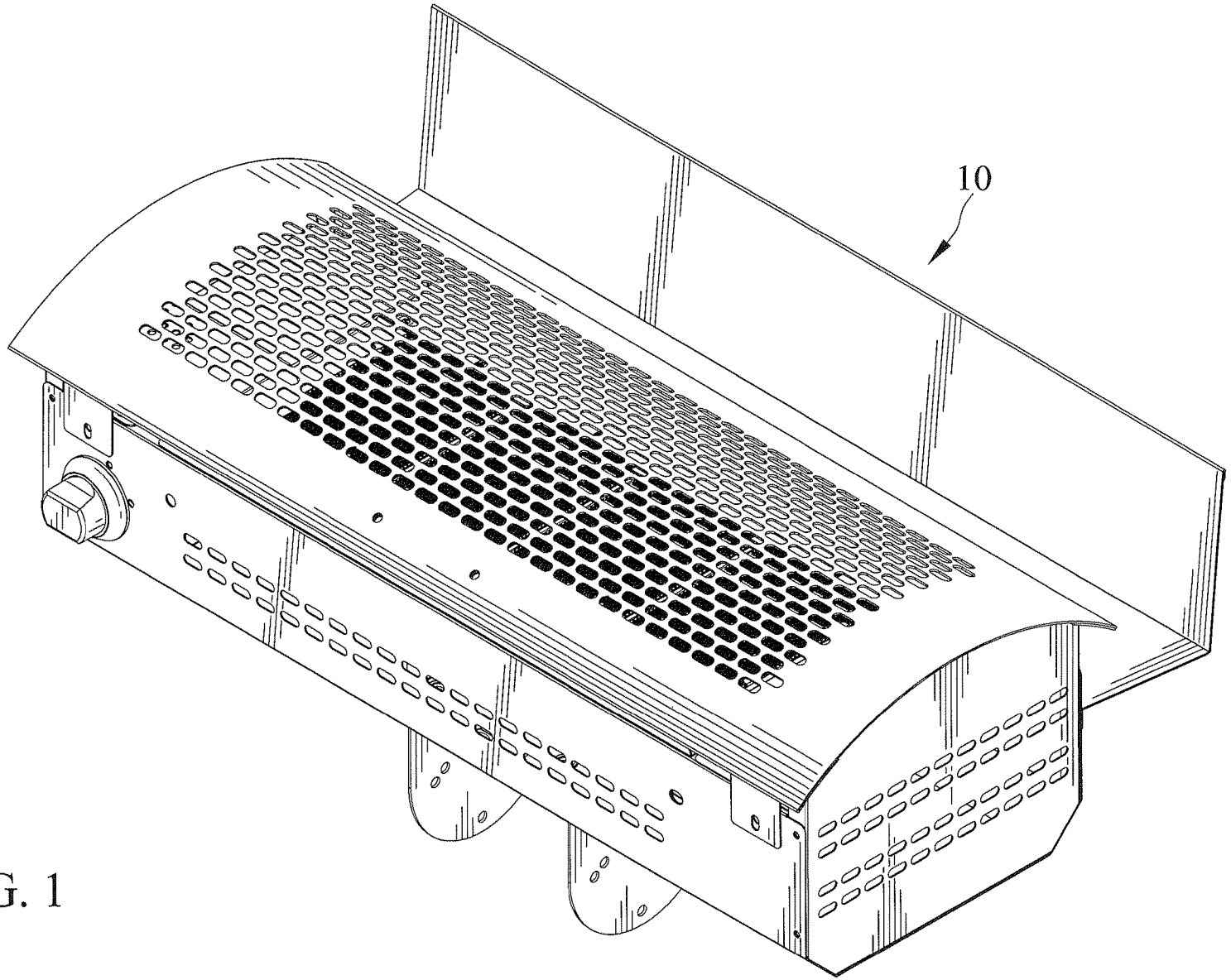
FIG. 1 is a perspective view of a windproof outdoor burner heater of a first embodiment according to the present invention.
Figure 2:
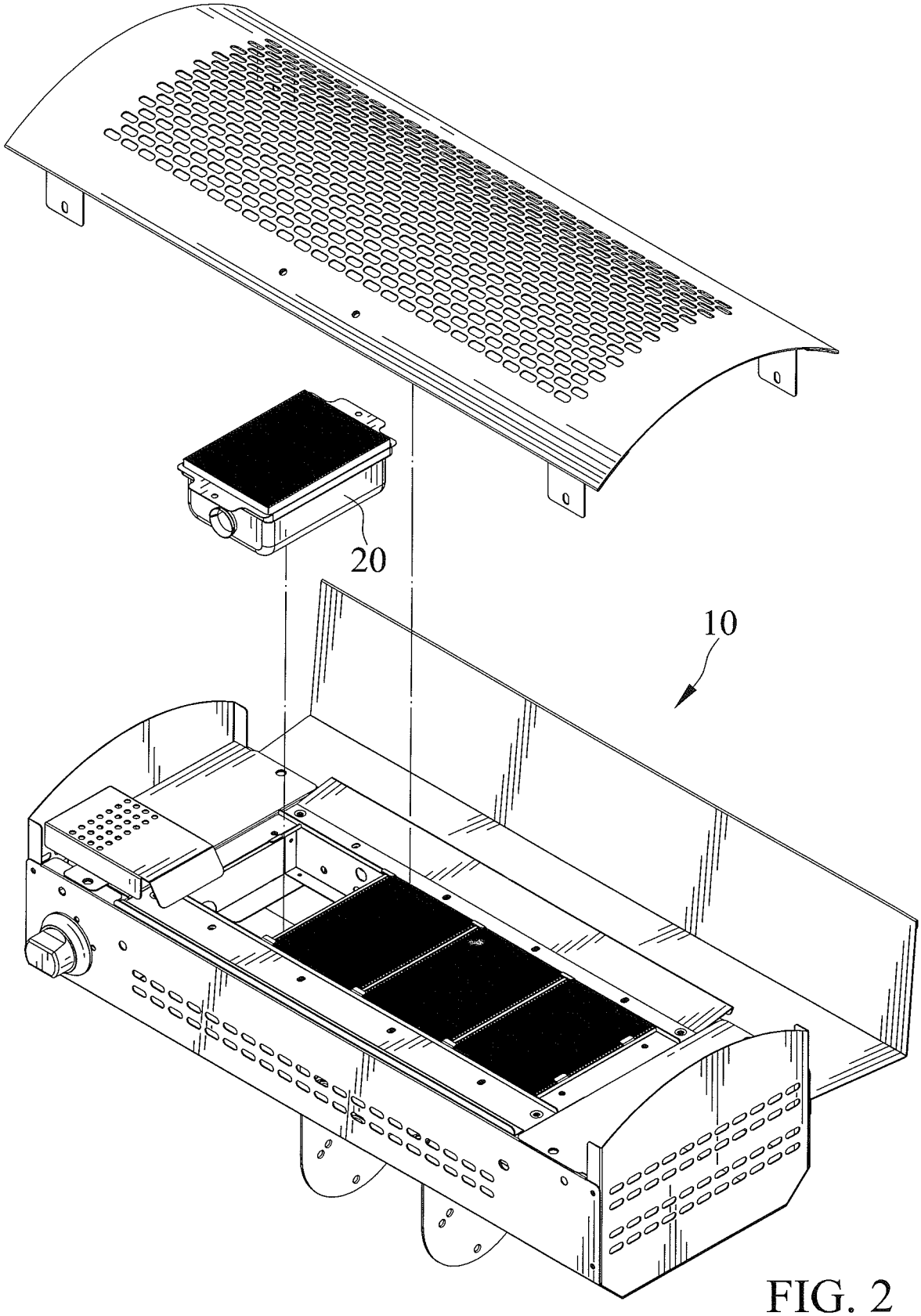
FIG. 2 is an exploded, perspective view of the windproof outdoor burner heater of FIG. 1.
Figure 3:
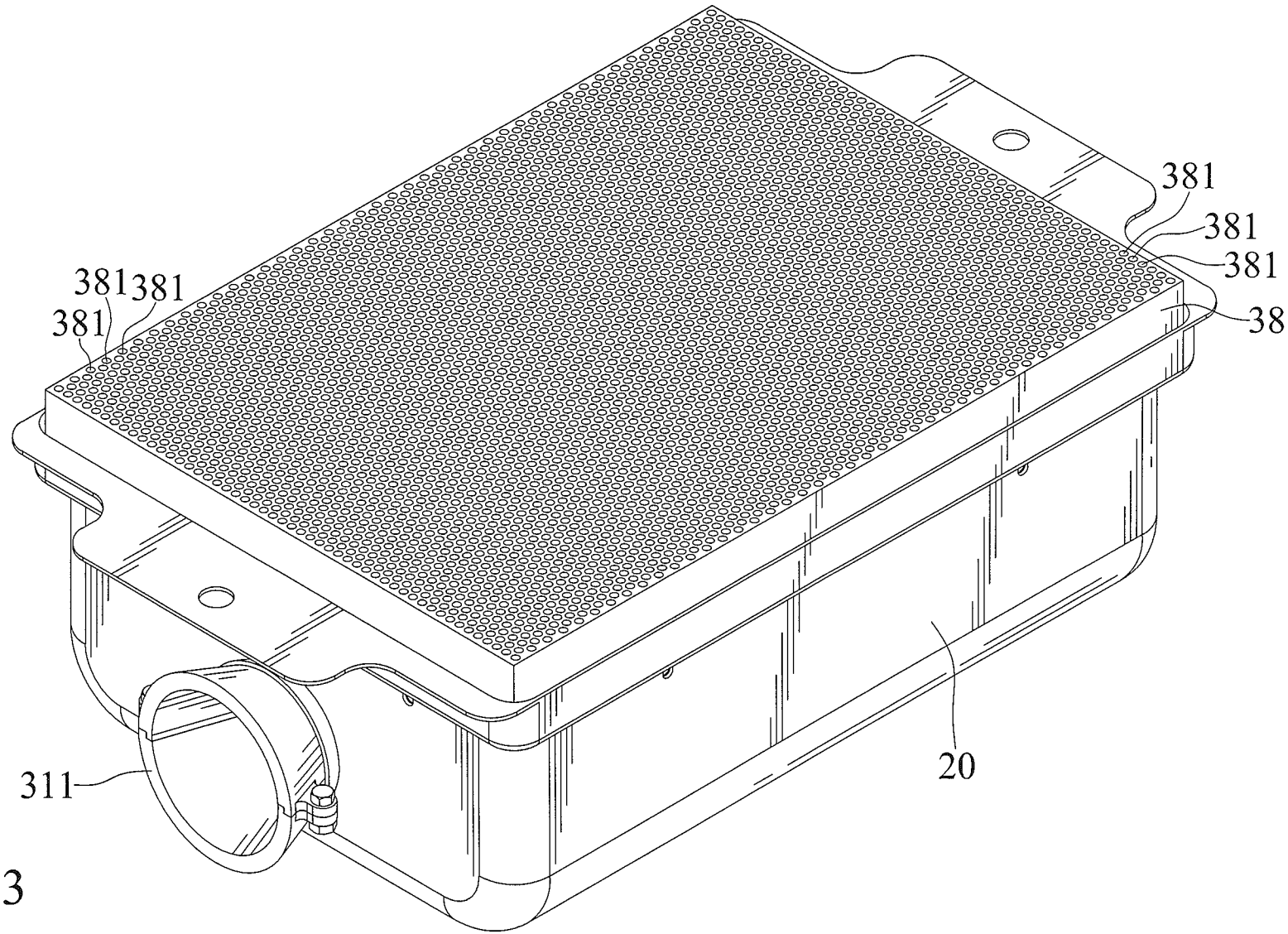
FIG. 3 is a perspective view of a casing and a flow-guiding device of the windproof outdoor burner heater of FIG. 1.
Figure 4:
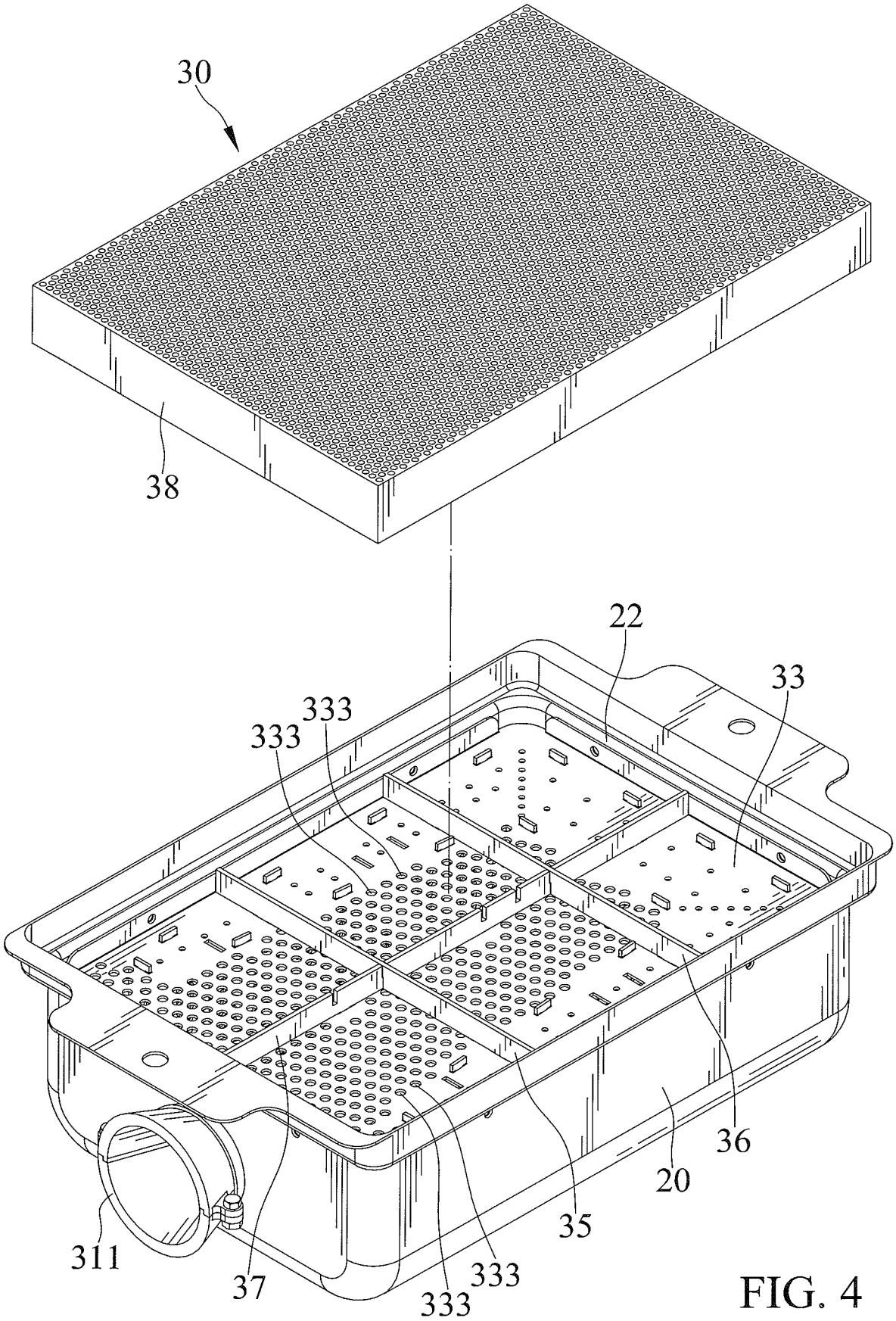
FIG. 4 is a view similar to FIG. 3 with a ceramic plate detached from the flow-guiding device of FIG. 3.
Figure 5:
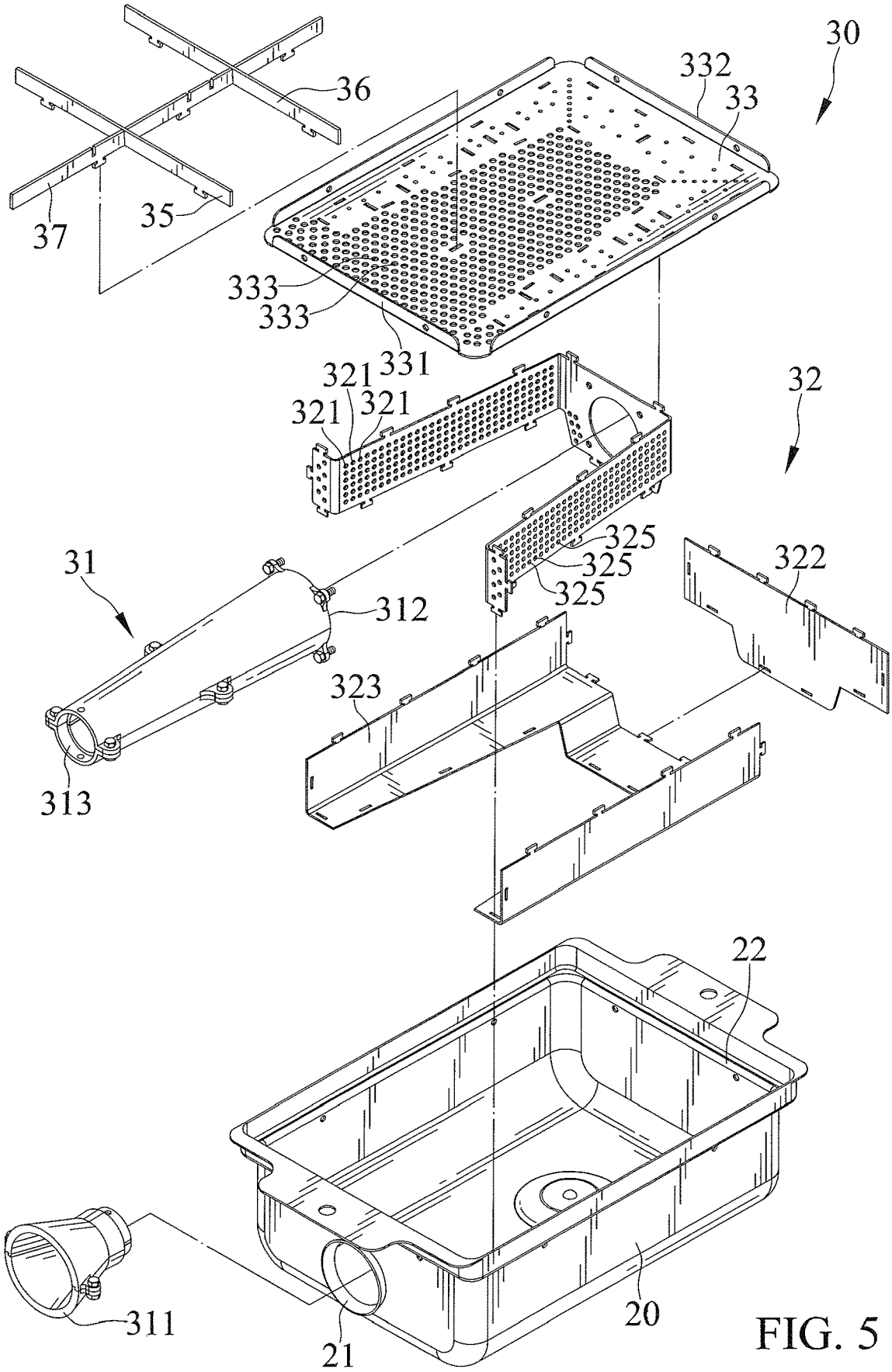
FIG. 5 is an exploded, perspective view of the flow-guiding device and the casing of FIG. 4.
Figure 6:
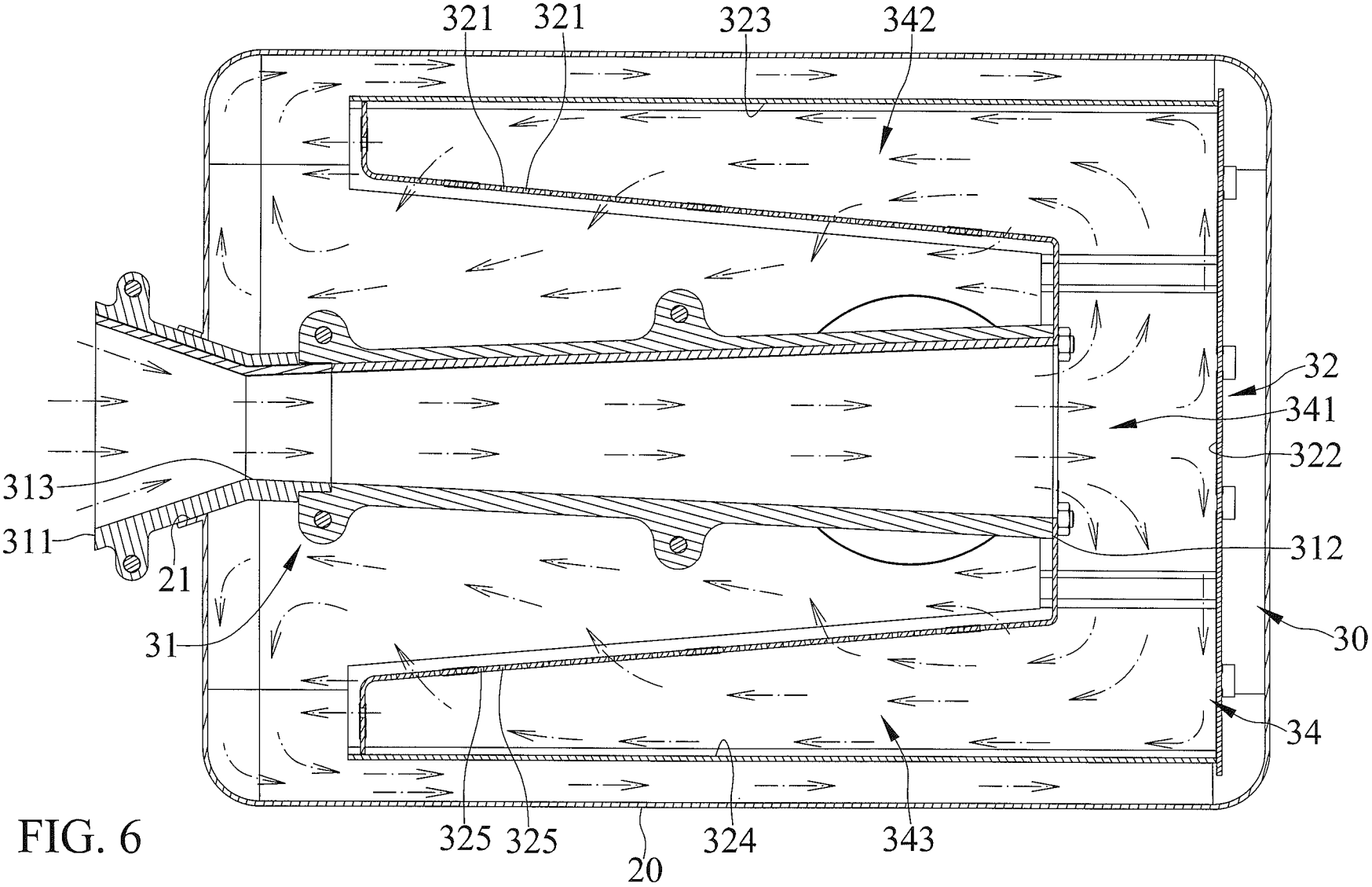
FIG. 6 is a cross-sectional view illustrating use of the windproof outdoor burner heater of FIG. 1.

With reference to FIGS. 1-7, a windproof outdoor heater burner 10 (hereinafter referred to as "the heater burner 10") of a first embodiment according to the present invention includes a casing 20 and a flow-guiding device 30. The casing 20 defines a chamber and includes an inlet 21 and an outlet 22 spaced from the inlet 21 in a longitudinal direction. The inlet 21 and the outlet 22 intercommunicate with the chamber.

The flow-guiding device 30 includes an inlet pipe 31, a flow-guiding member 32, and a diffuser plate 33. The inlet pipe 31 is connected to the inlet 21 and includes a first end 311 and a second end 312 opposite to the first end 311. The first end 311 of the inlet pipe 31 is located outside of the casing 20. The second end 312 of the inlet pipe 31 is located in the chamber of the casing 20. The inlet pipe 31 further includes a neck 313 located between the first end 311 and the second end 312 and received in the inlet 21 of the casing 20. An inner cross-sectional area of the neck 313 perpendicular to a longitudinal axis is smaller than an inner cross-sectional area of the first end 311 or the second end 312 of the inlet pipe 31 perpendicular to the longitudinal axis.

The flow-guiding member 32 is mounted in the chamber of the casing 20 and is connected to the second end 312 of the inlet pipe 31. The flow-guiding member 32 includes a flow-guiding channel 34 therein and a plurality of first through-holes 321. Each first through-hole 321 includes a first end intercommunicated with the flow-guiding channel 34 and a second end intercommunicated with the chamber of the casing 20. The flow-guiding channel 34 includes a first area extending non-rectilinearly from the second end 312 of the inlet pipe 31 to the first through-holes 321. The flow-guiding channel 34 includes a first section 341 and a second section 342 at a non-parallel angle to the first section 341 to form a turn therebetween. The first section 341 intercommunicates with the inlet pipe 31. The first section 341 and the second section 342 are connected and intercommunicate with each other.

The flow-guiding member 32 further includes a first baffle 322 adjacent to an inner periphery of the first section 341. The first baffle 322 is on a side of the first section 341 opposite to the inlet pipe 31 and faces the second end 312 of the inlet pipe 31. The flow-guiding member 32 further includes a second baffle 323 adjacent to an inner periphery of the second section 342. The second baffle 323 is on a side of the second section 342 opposite to the first section 341 and faces an end of the first section 341 opposite to the inlet pipe 31 and adjacent to the second section 342. The first through-holes 321 are located on a side of the flow-guiding member 32 adjacent to the second section 342 but opposite to the second baffle 323.

The flow-guiding channel 34 further includes a third section 343 connected and intercommunicated with an end of the first section 341 opposite to the second section 342. The first section 341 is at a non-parallel angle to the third section 343 to form a turn therebetween.

The flow-guiding member 32 further includes a third baffle 324 adjacent to an inner periphery of the third section 343. The third baffle 324 is on a side of the third section 343 opposite to first section 341 and faces an end of the first section 341 opposite to the second section 342. A side of the flow-guiding member 32 adjacent to the third section 343 but opposite to the third baffle 324 includes a plurality of second through-holes 325. Each second through-hole 325 has a first end intercommunicated with the flow-guiding channel 34 and a second end intercommunicated with the chamber of the casing 20. The flow-guiding channel 34 includes a second area extending non-rectilinearly from the second end 312*b* of the inlet pipe 31 to the second through-holes 325.

The diffuser plate 33 is connected to the outlet 22 and includes a first side 331 and a second side 332 opposite to the first side 331. The diffuser plate 33 further includes a plurality of first exhaust holes 333 located between the first side 331 and the second side 332 and intercommunicated with the chamber of the casing 20. The first exhaust holes 333 are not aligned with the flow-guiding member 32. The first exhaust holes 333 in the diffuser plate 33 have gradually reducing areas from the first side 331 to the second side 332 along the longitudinal axis. The sum of areas of the first exhaust holes 333 in the diffuser plate 33 is larger than the inner cross-sectional area of the neck 313 perpendicular to the longitudinal axis. The first side 331 is adjacent to the inlet 20 of the casing 21. The second side 332 is adjacent to a side of the casing 20 opposite to the inlet 21.

The flow-guiding device 30 further includes a first partitioning member 35, a second partitioning member 36, and a third partitioning member 37. The first partitioning member 35 abuts a side of the diffuser plate 33 opposite to the casing 20 and extends from the casing 20. The first partitioning member 35 is aligned with an area of the diffuser plate 33 having the first exhaust holes 333. The first exhaust holes 333 are divided into two sections by the first partitioning member 35. The second partitioning member 36 and the third partitioning member 37 abut the side of the diffuser plate 33 opposite to the casing 20 and extend away from the casing 20. The second partitioning member 36 is aligned with the area of the diffuser plate 33 having the first exhaust holes 333. The first exhaust holes 333 are divided into two sections by the second partitioning member 36. The extending direction of the first partitioning member 35 is parallel to the extending direction of the second partitioning member 36. The extending direction of the third partitioning member 37 is perpendicular to the extending direction of the first partitioning member 35. The third partitioning member 37 intersects with the first partitioning member 35 and the second partitioning member 36.

The flow-guiding device 30 further includes a ceramic plate 38 disposed on the side of the diffuser plate 33 opposite to the casing 20. The ceramic plate 38 includes a plurality of through-holes 381 extending from a side of the ceramic plate 38 adjacent to the diffuser plate 33 through another side of the ceramic plate 38 opposite to the diffuser plate 33. The ceramic plate 38 abuts a side of the first partitioning member 35, a side of the second partitioning member 36, and a side of the third partitioning member 37. The sides of the first, second, and third partitioning members 35, 36, 37 are opposite to the diffuser plate 33.

The heater burner 10 with the above structure permits the gas and air in the casing 20 to be mixed uniformly to increase the heating efficiency during combustion of the gas mixture and reducing the waste of the gas while achieving an excellent windproof effect. Extinction or backfire of the flame of the heater burner 10 will not occur even when subjected to a strong wind, increasing the use safety. After entering the casing 20, the gas passes through the flow-guiding channel 34 that extends non-rectilinearly, such that the gas is stopped and deflected by the first baffle 322, the second baffle 323, and the third baffle 324 to increase the turbulent effect for more uniformly mixing the gas and the air. The pressure and the concentration of the gas in the gas-mixing chamber are stable. Then, the gas mixture flows through the chamber of the casing 20, the diffuser plate 33, and the ceramic plate 38 for subsequent ignition. The heat energy generated by the combustion of the gas mixture is transmitted to the ambience of the heater burner 10 through radiation to increase the outside temperature (see FIG. 6).

Figure 7:
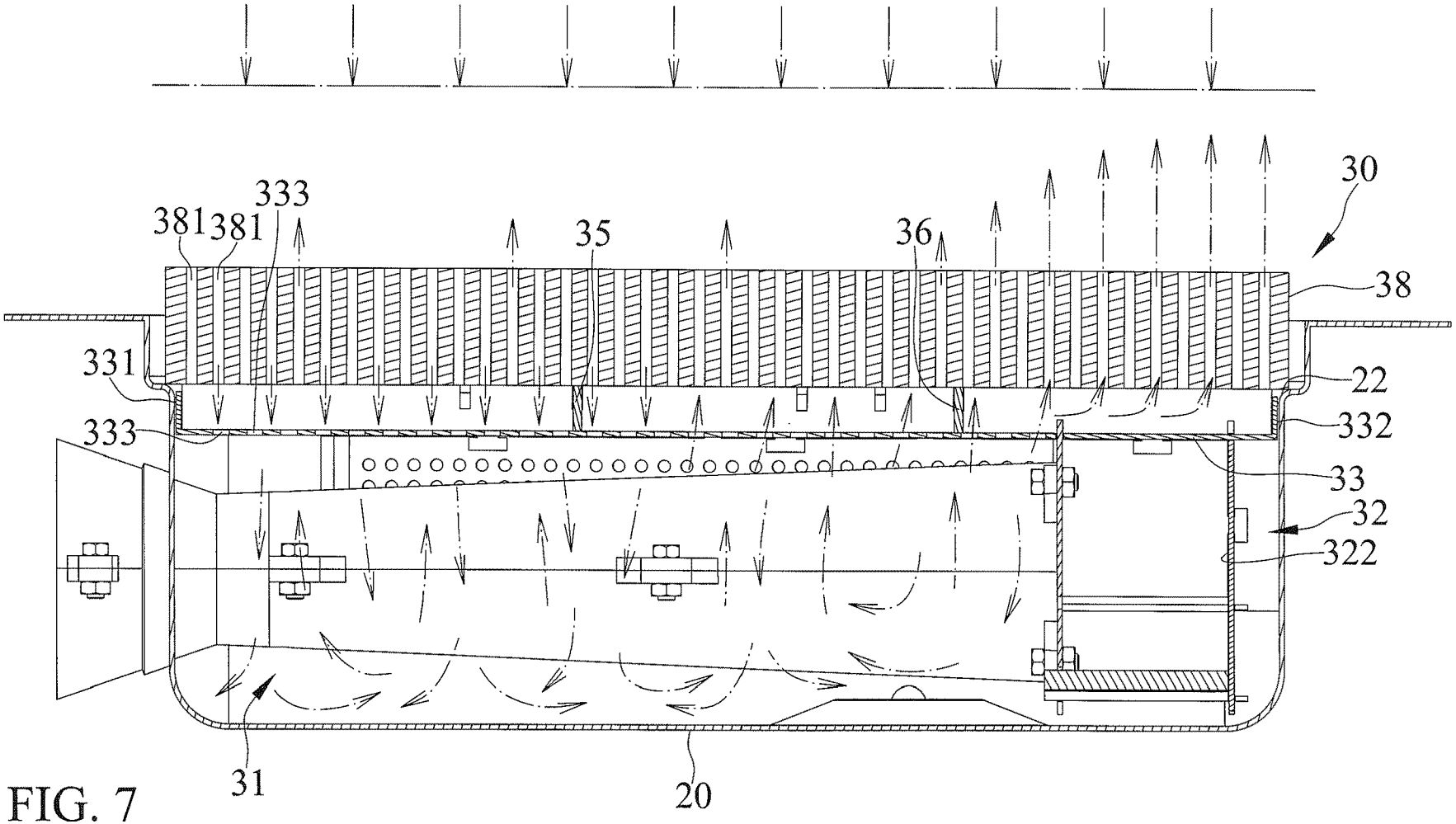
FIG. 7 is another cross-sectional view illustrating use of the windproof outdoor burner heater of FIG. 1 subject to a wind.

With reference to FIG. 7, when the heater burner 10 is subject to a wind from the front side, the wind passing through the ceramic plate 38 will not directly enter the flow-guiding channel 34 even if the wind enters the casing 20, because the first exhaust holes 333 of the diffuser plate 33 are not aligned with the flow-guiding channel 34. Furthermore, the first exhaust holes 333 in the diffuser plate 33 have gradually reducing areas from the first side 331 to the second side 332 along the longitudinal axis, such that the wind is apt to enter the casing 20 from an area adjacent to the first side 331 and then flows out of another area adjacent to the second side 332. Thus, even if the heater burner 10 is subjected to a wind, the flame keeps burning at the outside of the ceramic plate 38 without the risk of extinction and backfire.

Figure 8:
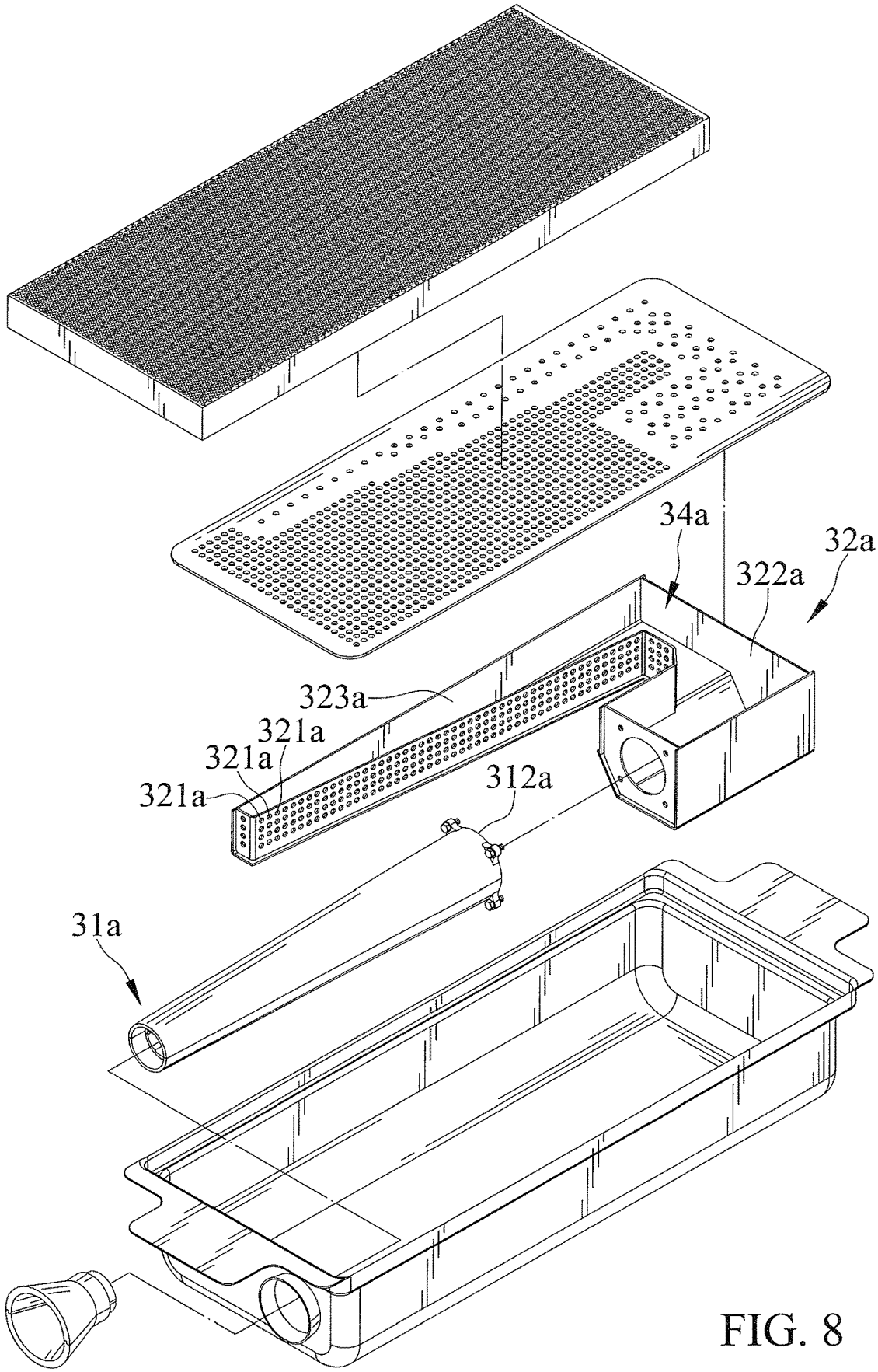
FIG. 8 is an exploded, perspective view of a casing and a flow-guiding device of a windproof outdoor burner heater of a second embodiment according to the present invention.
Figure 9:
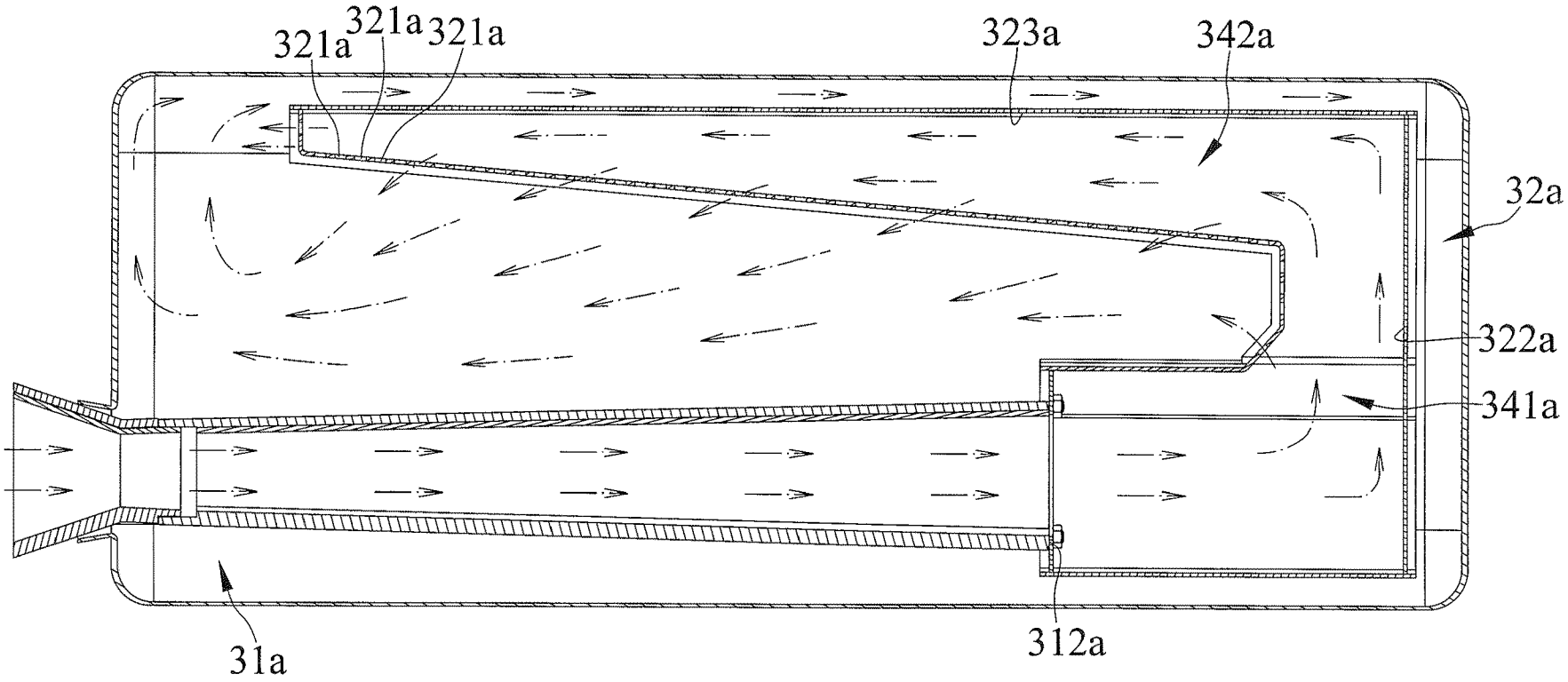
FIG. 9 is a cross-sectional view illustrating use of the windproof outdoor burner heater of FIG. 8.

FIGS. 8 and 9 show a heater burner 10 of a second embodiment according to the present invention which is substantially the same as the first embodiment. The main differences between the second embodiment and the first embodiment are that the flow-guiding channel 34*a* in the second embodiment includes a first section 341*a* and a second section 342*a* at a non-parallel angle to the first section 341*a* to form a turn therebetween. The first section 341*a* intercommunicates with the inlet pipe 31*a*. The first section 341*a* and the second section 342*a* are connected and intercommunicate with each other.

The flow-guiding member 32*a* includes a first baffle 322*a* adjacent to an inner periphery of the first section 341*a*. The first baffle 322*a* is on a side of the first section 341*a* opposite to the inlet pipe 31*a* and faces the second end 312*a* of the inlet pipe 31*a*. The flow-guiding member 32*a* further includes a second baffle 323*a* adjacent to an inner periphery of the second section 342*a*. The second baffle 323*a* is on a side of the second section 342*a* opposite to the first section 341*a* and faces an end of the second section 342*a* opposite to the first section 341*a* and adjacent to the second section 342*a*. The first through-holes 321*a* are located on a side of the flow-guiding member 32*a* adjacent to the second section 342*a* but opposite to the second baffle 323*a*.

Figure 10:
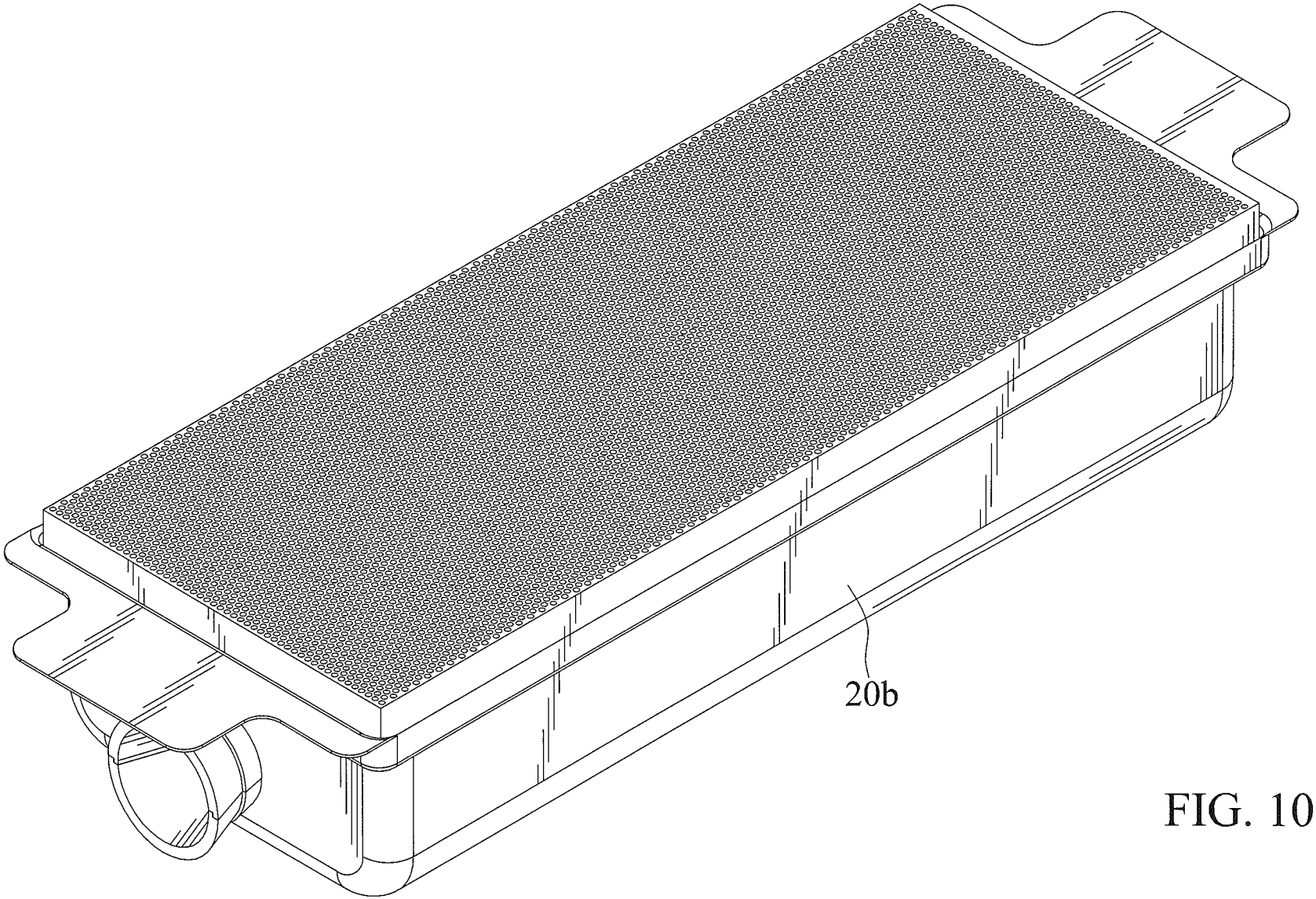
FIG. 10 is a perspective view of a casing and a flow-guiding device of a windproof outdoor burner heater of a third embodiment according to the present invention.
Figure 11:
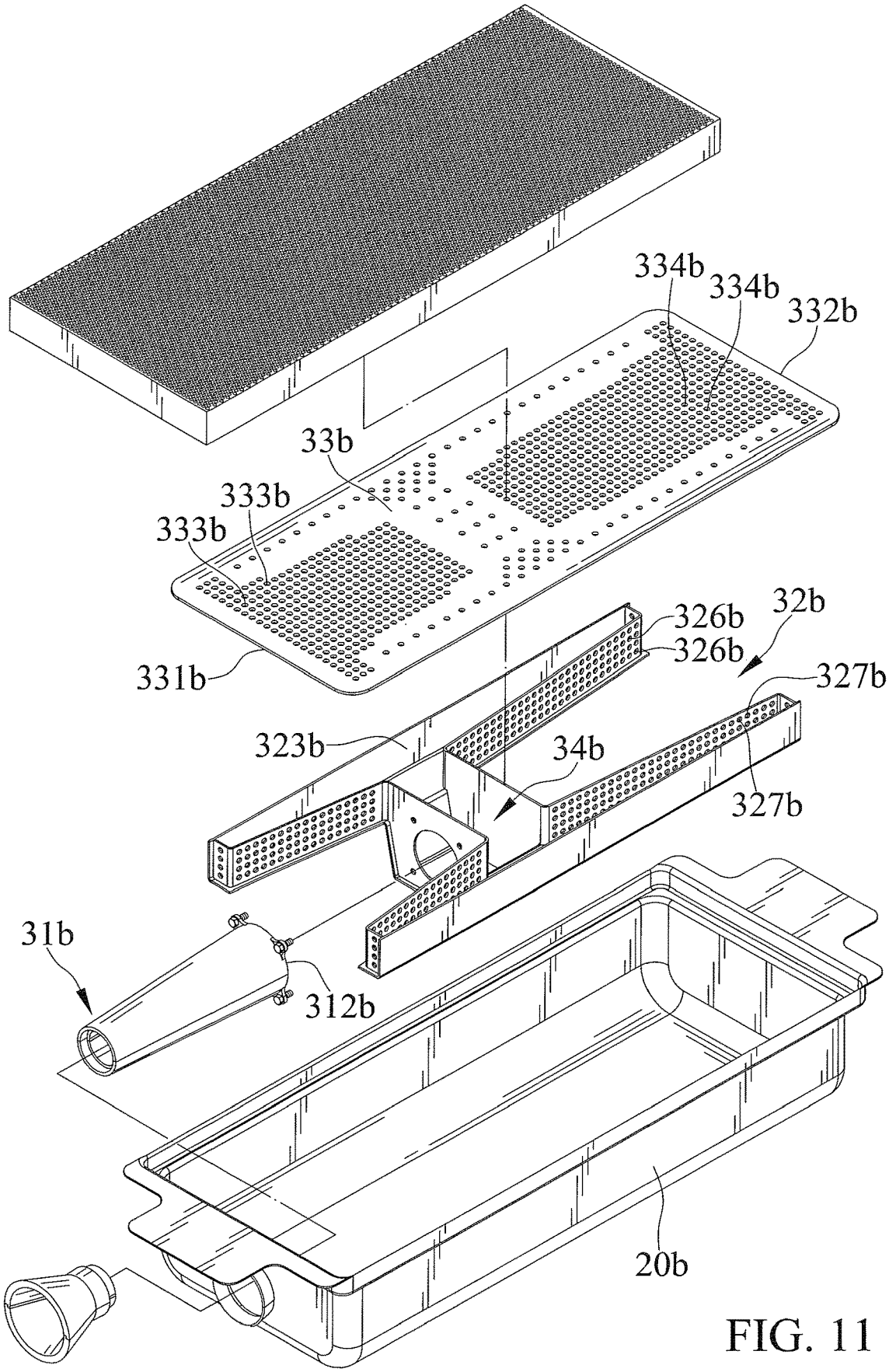
FIG. 11 is an exploded, perspective view of the casing and the flow-guiding device of the windproof outdoor burner heater of FIG. 10.
Figure 12:
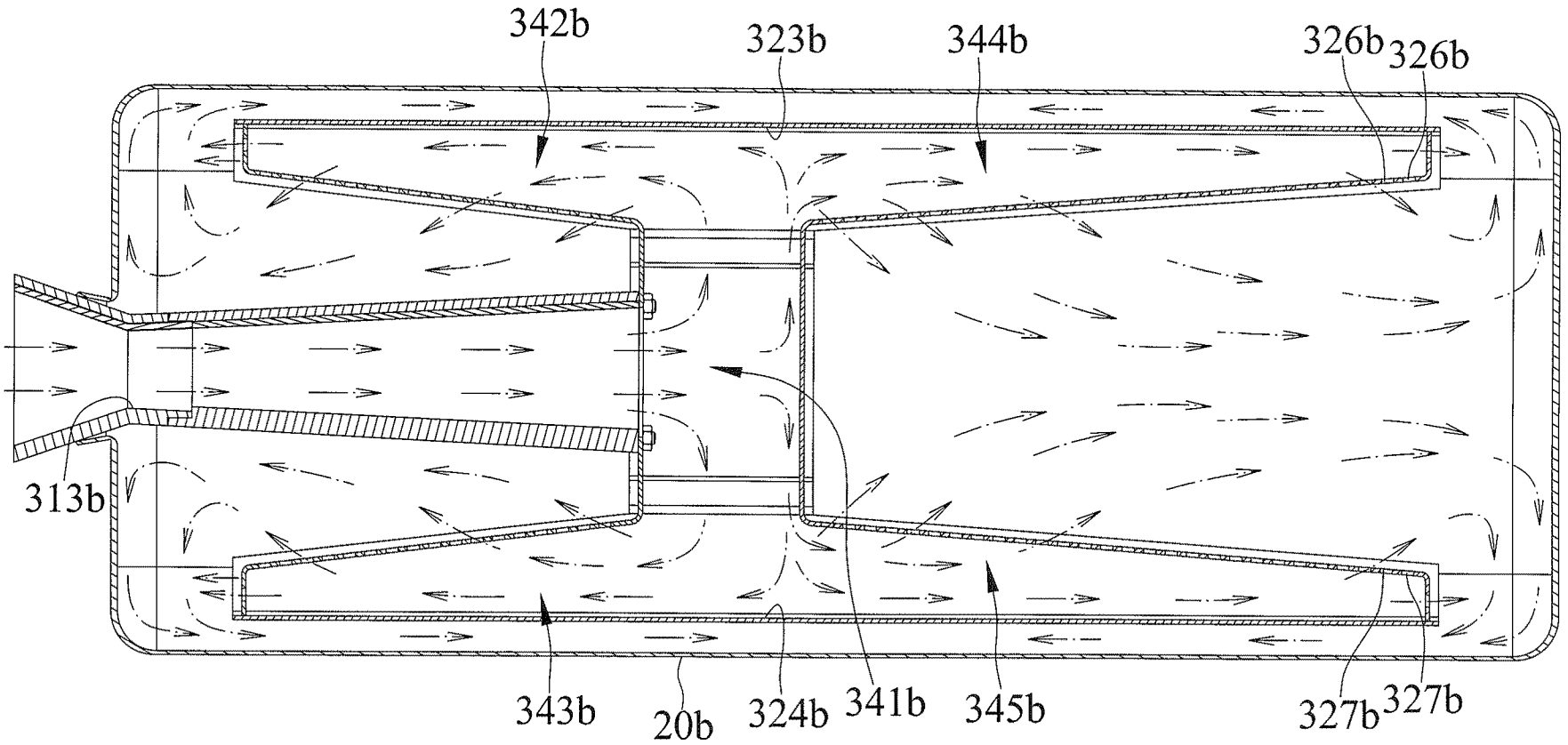
FIG. 12 is a cross-sectional view illustrating use of the windproof outdoor burner heater of FIG. 10.

FIGS. 10-12 show a heater burner 10 of a third embodiment according to the present invention which is substantially the same as the first embodiment. The main differences between the third embodiment and the first embodiment are that the flow-guiding channel 34*b* further includes a fourth section 344*b* and a fifth section 345*b*. The fourth section 344*b* is connected with the first section 341*b* and the second section 342*b* and extends in a direction away from the second section 342*b*. The second section 342*b* and the fourth section 344*b* extend along the same axis parallel to the longitudinal axis. The second baffle 323*b* is located adjacent to the inner periphery of the second section 342*b* and an inner periphery of the fourth section 344*b*. A turn is formed between the first section 341*b* and the fourth section 344*b*. A side of the flow-guiding member 32*b* adjacent to the fourth section 344*b* but opposite to the second baffle 323*b* includes a plurality of third through-holes 326*b*. Each third through-hole 326*b* has a first end intercommunicated with the flow-guiding channel 34*b* and a second end intercommunicated with the chamber of the casing 20*b*. The flow-guiding channel 34*b* further includes a third area extending non-rectilinearly from the second end 312*b* of the inlet pipe 31*b* to the third through-holes 326*b*.

The fifth section 345*b* is connected to the first section 341*b* and the third section 343*b* and extends in a direction away from the third section 343*b*. The third section 343*b* and the fifth section 345*b* extend along the same axis parallel to the longitudinal axis. The third baffle 324*b* is adjacent to the inner periphery of the third section 343*b* and an inner periphery of the fifth section 345*b*. A turn is formed between the first section 341*b* and the fifth section 345*b*. A side of the flow-guiding member 32*b* adjacent to the fifth section 345*b* but opposite to the third baffle 324*b* includes a plurality of fourth through-holes 327*b*. Each fourth through-holes 327*b* has a first end intercommunicated with the flow-guiding channel 34*b* and a second end intercommunicated with the chamber of the casing 20*b*. The flow-guiding channel 34*b* further includes a fourth area extending non-rectilinearly from the second end 312*b* of the inlet pipe 31*b* to the fourth through-holes 327*b*.

The diffuser plate 33*b* further includes a plurality of second exhaust holes 334*b* located between the first side 331*b* and the second side 332*b*, intercommunicated with the chamber of the casing 20*b*, and not aligned with the flow-guiding member 32*b*. The second exhaust holes 334*b* in the diffuser plate 33*b* have gradually reducing areas from the second side 332*b* to the first side 331*b* along the longitudinal axis. The sum of areas of the first exhaust holes 333*b* and the second exhaust holes 334*b* in the diffuser plate 33*b* is larger than the inner cross-sectional area of the neck 313*b* perpendicular to the longitudinal axis. The first section 341*b* is aligned with an area of the diffuser plate 33*b* having the first exhaust holes 333*b* and the second exhaust holes 334*b*.

The heater burner 10 according to the present invention permits the gas and air in the casing 20 to be mixed uniformly to increase the heating efficiency during combustion of the gas mixture, reducing the waste of the gas, while achieving an excellent windproof effect.

Although specific embodiments have been illustrated and described, numerous modifications and variations are still possible without departing from the scope of the invention. The scope of the invention is limited by the accompanying claims.

The invention claimed is:

1. A windproof outdoor heater burner comprising:

a casing defining a chamber and including an inlet and an outlet; and a flow-guiding device including an inlet pipe, a flow-guiding member, and a diffuser plate, wherein the inlet pipe is connected to the inlet, wherein the inlet pipe includes a first end and a second end opposite to the first end, wherein the first end of the inlet pipe is located outside of the casing, wherein the second end of the inlet pipe is located in the chamber of the casing, wherein the flow-guiding member is mounted in the chamber of the casing and is connected to the second end of the inlet pipe, wherein the flow-guiding member includes a flow-guiding channel therein and a plurality of first through-holes, wherein each of the plurality of the first through-holes includes a first end intercommunicated with the flow-guiding channel and a second end intercommunicated with the chamber of the casing, wherein the flow-guiding channel includes a first area extending from the second end of the inlet pipe to the plurality of first through-holes, wherein the diffuser plate is connected to the outlet and includes a first side and a second side opposite to the first side, wherein the diffuser plate further includes a plurality of first exhaust holes located between the first side and the second side and intercommunicated with the chamber of the casing, and wherein the plurality of first exhaust holes is not aligned with the flow-guiding member, wherein the flow-guiding channel includes a first section and a second section at a non-parallel angle to the first section to form a turn therebetween, wherein the first section intercommunicates with the inlet pipe, wherein the first section and the second section are connected and intercommunicate with each other, wherein the flow-guiding member further includes a first baffle adjacent to an inner periphery of the first section, wherein the first baffle is on a side of the first section opposite to the inlet pipe and faces the second end of the inlet pipe, wherein the flow-guiding member further includes a second baffle adjacent to an inner periphery of the second section, wherein the second baffle is on a side of the second section opposite to the first section and faces an end of the first section adjacent to the second section, wherein the plurality of first through-holes is located on a side of the flow-guiding member adjacent to the second section but opposite to the second baffle, wherein the flow-guiding channel further includes a third section, wherein the third section is connected and intercommunicates with an end of the first section opposite to the second section, wherein the first section is at a non-parallel angle to the third section to form a turn therebetween, wherein the flow-guiding member further includes a third baffle adjacent to an inner periphery of the third section, wherein the third baffle is on a side of the third section opposite to first section and faces an end of the first section opposite to the second section, wherein a side of the flow-guiding member adjacent to the third section but opposite to the third baffle includes a plurality of second through-holes, wherein each of the plurality of second through-holes has a first end intercommunicated with the flow-guiding channel and a second end intercommunicated with the chamber of the casing, and wherein the flow-guiding channel includes a second area extending from the second end of the inlet pipe to the plurality of second through-holes, wherein the flow-guiding device further includes a first partitioning member abutting a side of the diffuser plate opposite to the casing and extending away from the casing, wherein the first partitioning member is aligned with an area of the diffuser plate having the plurality of first exhaust holes, and wherein the plurality of first exhaust holes is divided into two sections by the first partitioning member, wherein the flow-guiding device further includes a second partitioning member and a third partitioning member, wherein the second partitioning member and the third partitioning member abut the side of the diffuser plate opposite to the casing and extend away from the casing, wherein the second partitioning member is aligned with the area of the diffuser plate having the plurality of first exhaust holes, wherein the plurality of exhaust holes is divided into two sections by the second partitioning member, wherein an extending direction of the first partitioning member is parallel to an extending direction of the second partitioning member, wherein an extending direction of the third partitioning member is perpendicular to the extending direction of the first partitioning member, and wherein the third partitioning member intersects with the first partitioning member and the second partitioning member.

2. The windproof outdoor heater burner as claimed in claim 1, wherein the flow-guiding channel further includes a fourth section and a fifth section, wherein the fourth section is connected with the first section and the second section and extends in a direction away from the second section, wherein the second section and the fourth section extend along a same axis parallel to a longitudinal axis, wherein the second baffle is located adjacent to the inner periphery of the second section and an inner periphery of the fourth section, wherein a turn is formed between the first section and the fourth section, wherein a side of the flow-guiding member adjacent to the fourth section but opposite to the second baffle includes a plurality of third through-holes, wherein each of the plurality of the third through-holes has a first end intercommunicated with the flow-guiding channel and a second end intercommunicated with the chamber of the casing, wherein the flow-guiding channel further includes a third area extending from the second end of the inlet pipe to the plurality of third through-holes, wherein the fifth section is connected to the first section and the third section and extends in a direction away from the third section, wherein the third section and the fifth section extend along a same axis parallel to the longitudinal axis, wherein the third baffle is adjacent to the inner periphery of the third section and an inner periphery of the fifth section, wherein a turn is formed between the first section and the fifth section, wherein a side of the flow-guiding member adjacent to the fifth section but opposite to the third baffle includes a plurality of fourth through-holes, wherein each of the plurality of fourth through-holes has a first end intercommunicated with the flow-guiding channel and a second end intercommunicated with the chamber of the casing, wherein the flow-guiding channel further includes a fourth area extending from the second end of the inlet pipe to the plurality of fourth through-holes.

3. The windproof outdoor heater burner as claimed in claim 2, wherein the inlet and the outlet are respectively defined in two adjacent sides of the casing, wherein the inlet pipe further includes a neck located between the first end and the second end of the inlet pipe and received in the inlet of the casing, wherein an inner cross-sectional area of the neck perpendicular to the longitudinal axis is smaller than an inner cross-sectional area of the first end or the second end perpendicular to the longitudinal axis, wherein the diffuser plate further includes a plurality of second exhaust holes located between the first side and the second side, intercommunicated with the chamber of the casing, and not aligned with the flow-guiding member, and wherein a sum of areas of the plurality of first exhaust holes and the plurality of second exhaust holes in the diffuser plate is larger than the inner cross-sectional area of the neck perpendicular to the longitudinal axis.

4. The windproof outdoor heater burner as claimed in claim 3, wherein the plurality of first exhaust holes in the diffuser plate has gradually reducing areas from the first side to the second side along the longitudinal axis, wherein the first side of the diffuser plate is adjacent to the inlet of the casing, wherein the second side of the diffuser plate is adjacent to a side of the casing opposite to the inlet, and wherein the plurality of second exhaust holes in the diffuser plate has gradually reducing areas from the second side to the first side along the longitudinal axis.

5. The windproof outdoor heater burner as claimed in claim 4, wherein the first section of the flow-guiding channel is aligned with an area of the diffuser plate having the plurality of first exhaust holes and the plurality of several second exhaust holes.

6. The windproof outdoor heater burner as claimed in claim 1, wherein the inlet and the outlet are respectively defined in two adjacent sides of the casing, wherein the inlet pipe further includes a neck located between the first end and the second end of the inlet pipe and received in the inlet of the casing, wherein an inner cross-sectional area of the neck perpendicular to a longitudinal axis is smaller than an inner cross-sectional area of the first end or the second end of the inlet pipe perpendicular to the longitudinal axis, wherein a sum of areas of the plurality of first exhaust holes in the diffuser plate is larger than the inner cross-sectional area of the neck.

7. The windproof outdoor heater burner as claimed in claim 1, wherein the plurality of first exhaust holes in the diffuser plate has gradually reducing areas from the first side to the second side along a longitudinal axis, wherein the first side of the diffuser plate is adjacent to the inlet of the casing, and wherein the second side of the diffuser plate is adjacent to a side of the casing opposite to the inlet.

8. The windproof outdoor heater burner as claimed in claim 1, wherein the flow-guiding device further includes a ceramic plate disposed on the side of the diffuser plate opposite to the casing, wherein the ceramic plate includes a plurality of through-holes extending from a side of the ceramic plate adjacent to the diffuser plate through another side of the ceramic plate opposite to the diffuser plate, wherein the ceramic plate abuts a side of the first partitioning member, a side of the second partitioning member, and a side of the third partitioning member, and wherein the sides of the first, second, and third partitioning members are opposite to the diffuser plate.

9. A windproof outdoor heater burner comprising:

a casing defining a chamber and including an inlet and an outlet; and a flow-guiding device including an inlet pipe, a flow-guiding member, and a diffuser plate, wherein the inlet pipe is connected to the inlet, wherein the inlet pipe includes a first end and a second end opposite to the first end, wherein the first end of the inlet pipe is located outside of the casing, wherein the second end of the inlet pipe is located in the chamber of the casing, wherein the flow-guiding member is mounted in the chamber of the casing and is connected to the second end of the inlet pipe, wherein the flow-guiding member includes a flow-guiding channel therein and a plurality of first through-holes, wherein each of the plurality of the first through-holes includes a first end intercommunicated with the flow-guiding channel and a second end intercommunicated with the chamber of the casing, wherein the flow-guiding channel includes a first area extending from the second end of the inlet pipe to the plurality of first through-holes, wherein the diffuser plate is connected to the outlet and includes a first side and a second side opposite to the first side, wherein the diffuser plate further includes a plurality of first exhaust holes located between the first side and the second side and intercommunicated with the chamber of the casing, and wherein the plurality of first exhaust holes is not aligned with the flow-guiding member, wherein the flow-guiding channel includes a first section and a second section at a non-parallel angle to the first section to form a turn therebetween, wherein the first section intercommunicates with the inlet pipe, wherein the first section and the second section are connected and intercommunicate with each other, wherein the flow-guiding member further includes a first baffle adjacent to an inner periphery of the first section, wherein the first baffle is on a side of the first section opposite to the inlet pipe and faces the second end of the inlet pipe, wherein the flow-guiding member further includes a second baffle adjacent to an inner periphery of the second section, wherein the second baffle is on a side of the second section opposite to the first section and faces an end of the first section adjacent to the second section, wherein the plurality of first through-holes is located on a side of the flow-guiding member adjacent to the second section but opposite to the second baffle, wherein the flow-guiding device further includes a ceramic plate on a side of the diffuser plate opposite to the casing, wherein the ceramic plate includes a plurality of through-holes extending from a side of the ceramic plate adjacent to the diffuser plate through another side of the ceramic plate opposite to the diffuser plate.

10. A windproof outdoor heater burner comprising:

a casing defining a chamber and including an inlet and an outlet; and a flow-guiding device including an inlet pipe, a first partitioning member, and a diffuser plate, wherein the inlet pipe is connected to the inlet, wherein the diffuser plate is connected to the outlet and includes a first side and a second side opposite to the first side, wherein the diffuser plate further includes a plurality of first exhaust holes located between the first side and the second side and intercommunicated with the chamber of the casing, wherein the first partitioning member abuts a side of the diffuser plate opposite to the casing and extends away from the casing, wherein the first partitioning member is aligned with an area of the diffuser plate having the plurality of first exhaust holes, and wherein the plurality of first exhaust holes is divided into two sections by the first partitioning member, wherein the flow-guiding device further includes a second partitioning member and a third partitioning member, wherein the second partitioning member and the third partitioning member abut the side of the diffuser plate opposite to the casing and extend away from the casing, wherein the second partitioning member is aligned with the area of the diffuser plate having the plurality of first exhaust holes, wherein the plurality of exhaust holes is divided into two sections by the second partitioning member, wherein an extending direction of the first partitioning member is parallel to an extending direction of the second partitioning member, wherein an extending direction of the third partitioning member is perpendicular to the extending direction of the first partitioning member, and wherein the third partitioning member intersects with the first partitioning member and the second partitioning member.

11. The windproof outdoor heater burner as claimed in claim 10, wherein the flow-guiding device further includes a ceramic plate disposed on the side of the diffuser plate opposite to the casing, wherein the ceramic plate includes a plurality of through-holes extending from a side of the ceramic plate adjacent to the diffuser plate through another side of the ceramic plate opposite to the diffuser plate, wherein the ceramic plate abuts a side of the first partitioning member, a side of the second partitioning member, and a side of the third partitioning member, and wherein the sides of the first, second, and third partitioning members are opposite to the diffuser plate.

12. The windproof outdoor heater burner as claimed in claim 10, wherein the flow-guiding device includes a flow-guiding member, wherein the inlet pipe includes a first end and a second end opposite to the first end, wherein the first end of the inlet pipe is located outside of the casing, wherein the second end of the inlet pipe is located in the chamber of the casing, wherein the flow-guiding member is mounted in the chamber of the casing and is connected to the second end of the inlet pipe, wherein the flow-guiding member includes a flow-guiding channel therein and a plurality of first through-holes, wherein each of the plurality of the first through-holes includes a first end intercommunicated with the flow-guiding channel and a second end intercommunicated with the chamber of the casing, wherein the flow-guiding channel includes a first area extending from the second end of the inlet pipe to the plurality of first through-holes, and wherein the plurality of first exhaust holes is not aligned with the flow-guiding member.

13. The windproof outdoor heater burner as claimed in claim 12, wherein the flow-guiding channel includes a first section and a second section at a non-parallel angle to the first section to form a turn therebetween, wherein the first section intercommunicates with the inlet pipe, wherein the first section and the second section are connected and intercommunicate with each other, wherein the flow-guiding member further includes a first baffle adjacent to an inner periphery of the first section, wherein the first baffle is on a side of the first section opposite to the inlet pipe and faces the second end of the inlet pipe, wherein the flow-guiding member further includes a second baffle adjacent to an inner periphery of the second section, wherein the second baffle is on a side of the second section opposite to the first section and faces an end of the first section adjacent to the second section, wherein the plurality of first through-holes is located on a side of the flow-guiding member adjacent to the second section but opposite to the second baffle.

14. The windproof outdoor heater burner as claimed in claim 13, wherein the flow-guiding channel further includes a third section, wherein the third section is connected and intercommunicates with an end of the first section opposite to the second section, wherein the first section is at a non-parallel angle to the third section to form a turn therebetween, wherein the flow-guiding member further includes a third baffle adjacent to an inner periphery of the third section, wherein the third baffle is on a side of the third section opposite to first section and faces an end of the first section opposite to the second section, wherein a side of the flow-guiding member adjacent to the third section but opposite to the third baffle includes a plurality of second through-holes, wherein each of the plurality of second through-holes has a first end intercommunicated with the flow-guiding channel and a second end intercommunicated with the chamber of the casing, and wherein the flow-guiding channel includes a second area extending from the second end of the inlet pipe to the plurality of second through-holes.

15. The windproof outdoor heater burner as claimed in claim 14, wherein the flow-guiding channel further includes a fourth section and a fifth section, wherein the fourth section is connected with the first section and the second section and extends in a direction away from the second section, wherein the second section and the fourth section extend along a same axis parallel to a longitudinal axis, wherein the second baffle is located adjacent to the inner periphery of the second section and an inner periphery of the fourth section, wherein a turn is formed between the first section and the fourth section, wherein a side of the flow-guiding member adjacent to the fourth section but opposite to the second baffle includes a plurality of third through-holes, wherein each of the plurality of the third through-holes has a first end intercommunicated with the flow-guiding channel and a second end intercommunicated with the chamber of the casing, wherein the flow-guiding channel further includes a third area extending from the second end of the inlet pipe to the plurality of third through-holes, wherein the fifth section is connected to the first section and the third section and extends in a direction away from the third section, wherein the third section and the fifth section extend along a same axis parallel to the longitudinal axis, wherein the third baffle is adjacent to the inner periphery of the third section and an inner periphery of the fifth section, wherein a turn is formed between the first section and the fifth section, wherein a side of the flow-guiding member adjacent to the fifth section but opposite to the third baffle includes a plurality of fourth through-holes, wherein each of the plurality of fourth through-holes has a first end intercommunicated with the flow-guiding channel and a second end intercommunicated with the chamber of the casing, and wherein the flow-guiding channel further includes a fourth area extending from the second end of the inlet pipe to the plurality of fourth through-holes.

16. The windproof outdoor heater burner as claimed in claim 14, wherein the inlet and the outlet are respectively defined in two adjacent sides of the casing, wherein the inlet pipe further includes a neck located between the first end and the second end of the inlet pipe and received in the inlet of the casing, wherein an inner cross-sectional area of the neck perpendicular to a longitudinal axis is smaller than an inner cross-sectional area of the first end or the second end of the inlet pipe perpendicular to the longitudinal axis, and wherein a sum of areas of the plurality of first exhaust holes in the diffuser plate is larger than the inner cross-sectional area of the neck.

17. The windproof outdoor heater burner as claimed in claim 14, wherein the plurality of first exhaust holes in the diffuser plate has gradually reducing areas from the first side to the second side along a longitudinal axis, wherein the first side of the diffuser plate is adjacent to the inlet of the casing, and wherein the second side of the diffuser plate is adjacent to a side of the casing opposite to the inlet.

18. The windproof outdoor heater burner as claimed in claim 15, wherein the inlet and the outlet are respectively defined in two adjacent sides of the casing, wherein the inlet pipe further includes a neck located between the first end and the second end of the inlet pipe and received in the inlet of the casing, wherein an inner cross-sectional area of the neck perpendicular to the longitudinal axis is smaller than an inner cross-sectional area of the first end or the second end perpendicular to the longitudinal axis, wherein the diffuser plate further includes a plurality of second exhaust holes located between the first side and the second side, intercommunicated with the chamber of the casing, and not aligned with the flow-guiding member, and wherein a sum of areas of the plurality of first exhaust holes and the plurality of second exhaust holes in the diffuser plate is larger than the inner cross-sectional area of the neck perpendicular to the longitudinal axis.

19. The windproof outdoor heater burner as claimed in claim 18, wherein the plurality of first exhaust holes in the diffuser plate has gradually reducing areas from the first side to the second side along the longitudinal axis, wherein the first side of the diffuser plate is adjacent to the inlet of the casing, wherein the second side of the diffuser plate is adjacent to a side of the casing opposite to the inlet, and wherein the plurality of second exhaust holes in the diffuser plate has gradually reducing areas from the second side to the first side along the longitudinal axis.

20. The windproof outdoor heater burner as claimed in claim 19, wherein the first section of the flow-guiding channel is aligned with an area of the diffuser plate having the plurality of first exhaust holes and the plurality of several second exhaust holes.

* * * * *